United States Patent [19]

Weatherhead et al.

[11] Patent Number: 4,917,283

[45] Date of Patent: Apr. 17, 1990

[54] STRIP FEED ROLLER

[76] Inventors: Franklin L. Weatherhead; Harold E. Boyer, both of P.O. Box 419, 107 N. Main St., Botkins, Ohio 45306

[21] Appl. No.: 315,740

[22] Filed: Feb. 27, 1989

[51] Int. Cl.[4] ..... B65H 20/02

[52] U.S. Cl. ..... 226/190; 226/191

[58] Field of Search ..... 226/190, 191, 186, 192, 226/193

[56] References Cited

U.S. PATENT DOCUMENTS

| | | | |
|---|---|---|---|
| 241,461 | 5/1981 | Waring . | |
| 709,694 | 9/1902 | Bietenholz | 29/121.5 |
| 1,332,700 | 3/1920 | Wheeler | 226/190 X |
| 3,060,545 | 10/1962 | Thiel et al. | 29/116.1 |
| 3,139,226 | 6/1964 | Russell | 226/190 |
| 3,240,442 | 2/1964 | Kilmartin | 226/193 |
| 3,447,221 | 6/1969 | Odiorne | 29/121.1 |
| 3,550,258 | 12/1970 | Odiorne . | |
| 3,622,059 | 11/1971 | Savela | 226/190 |
| 4,104,845 | 8/1978 | Hoffmann | 53/410 |
| 4,375,971 | 5/1983 | Moll . | |

*Primary Examiner*—Stuart S. Levy
*Assistant Examiner*—Paul Thomas Bowen
*Attorney, Agent, or Firm*—Jacox & Meckstroth

[57] ABSTRACT

A strip feed roller for feeding paper or paper-like material or the like. The roller is created for use as a part of apparatus, such as a folder machine, or the like. The strip feed roller has a cylindrical surface portion of substantially uniform diameter along the length thereof. The cylindrical surface portion of the roller has axially extending relatively straight sections of relatively hard or rigid material, such as metal, and relatively straight sections of a rubber-like material, such as urethane. The sections are arranged in alternating relationship. Thus, the roller is capable of applying a firm grip upon a strip, without creasing or wrinkling or cutting the strip. Also, the roller is capable of feeding the strip accurately and precisely without angular, lateral, or longitudinal slippage.

20 Claims, 1 Drawing Sheet

FIG-1
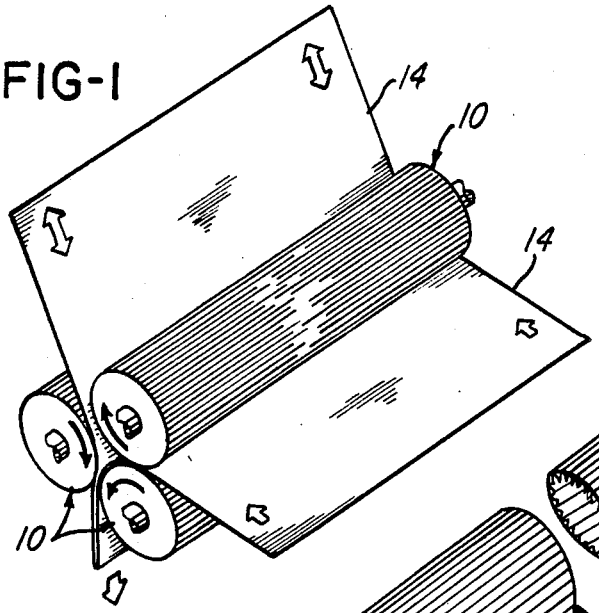
FIG-2
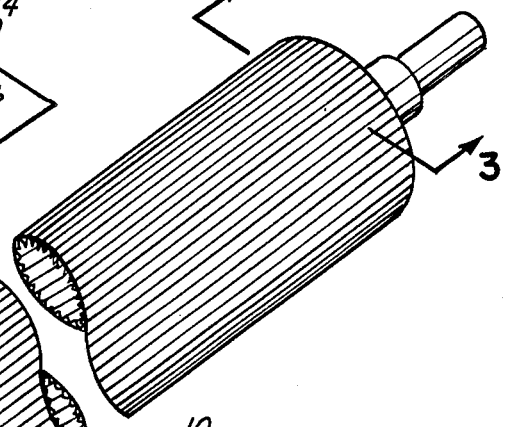
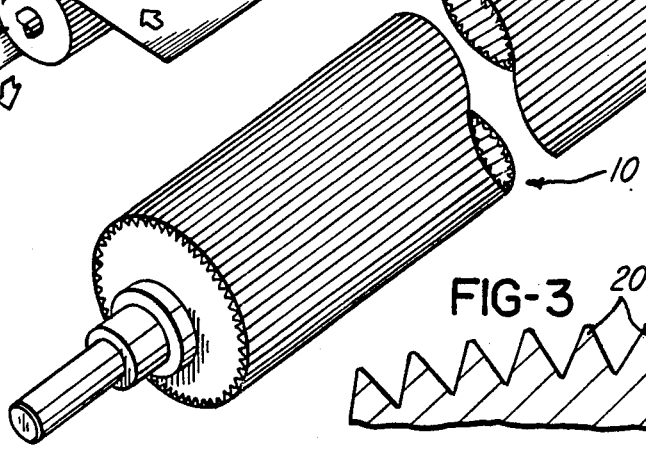
FIG-3
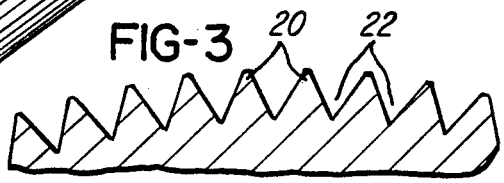
FIG-4
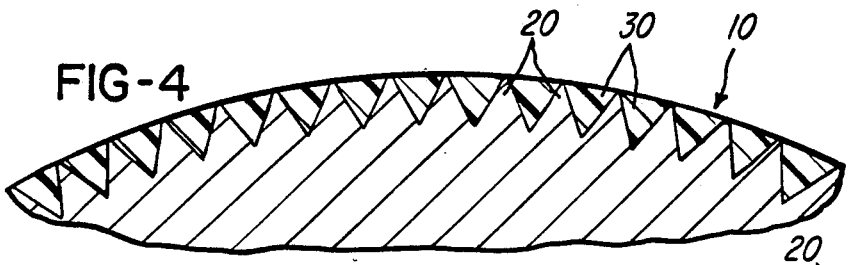
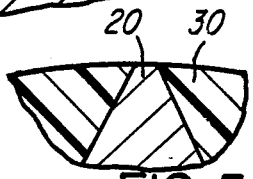
FIG-5
FIG-6
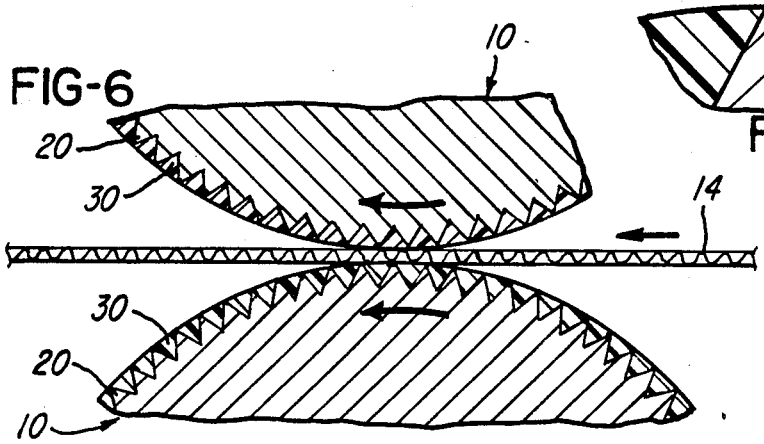

STRIP FEED ROLLER

BACKGROUND OF THE INVENTION

A strip feed roller or cylinder is employed in moving strip material, such as paper or paper-like material or fabric material or the like. A strip feed roller or cylinder may be a portion of a strip or web or sheet folder machine or the like. In most situations, a strip feed roller or cylinder must be one which moves strip material accurately, without slippage longitudinally, without slippage laterally, and without slippage angularly.

In attempts to provide a strip feed roller which maintains extreme accuracy, without slippage, some strip feed rollers have firm, rigid grasping surfaces. Such surfaces have been found to cut into the strip. Some strip feed rollers have been found to cause smudging in pressure sensitive copy paper. Therefore, such strip feed rollers are not acceptable.

U.S. Pat. Nos. 241,461, 709,694, 3,060,545, 3,240,442, and 3,447,221 disclose strip feed rollers and mechanisms. However, so far as is known, the rollers and mechanisms disclosed in these patents do not contain the details of the structure of this invention.

It is therefore an object of this invention to provide a strip feed roller or cylinder which is capable of extreme accuracy in strip feeding.

It is another object of this invention to provide such a strip feed roller which does not cut into the strip and which does not cause smudging in pressure sensitive copy paper.

Other objects and advantages of this invention reside in the construction of parts, the combination thereof, the method of production and the mode of operation, as will become more apparent from the following description.

SUMMARY OF THE INVENTION

This invention comprises a strip feed roller or cylinder which is particularly created for accurate and precise feeding of paper or paper-like material. However, a strip feed roller or cylinder of this invention may be employed in feeding or moving strips of other materials. The strip feed roller of this invention is one which accurately feeds paper or paper-like material or other relatively soft materials but does not cause cutting of the paper or material and which does not cause bursting or fracturing of capsules in carbonless copy paper.

A strip feed roller of this invention comprises an elongate cylindrical member which is preferably of a rigid material, such as metallic material or rigid plastics material, or other rigid material. The cylindrical member is knurled or grooved. Thus, initially the surface of the roller has alternate grooves and teeth. In the production of a strip feed roller of this invention, the grooves between the teeth in the cylindrical member or roller are filled with rubber material or rubberlike plastics material, such as urethane. Then the surface of the roller is cut to form a cylinder of constant diameter throughout its length, and thus the roller has a smooth cylindrical surface. In the cutting of the surface only a small portion of each tooth is exposed on the cylindrical surface. Thus, the roller has a cylindrical surface which has alternate axially extending narrow sections of rigid material and alternate axially extending narrow sections of resilient material.

Therefore, when a strip feed roller of this invention is employed in feeding a strip of material, such as a strip of paper or paper-like material, the paper is alternately engaged by the rigid teeth and alternately engaged by the resilient material, which is positioned between the teeth. The narrow rigid sections formed by the teeth provide a firm grip upon the paper, and the narrow resilient sections between the rigid teeth prevent deformation of the surface of the paper and thus prevent damage to the paper. The narrow resilient sections also engage the paper and serve as feed elements for movement of the paper.

The narrow resilient sections aid in paper feed action and also prevent damage to the paper. The narrow resilient sections prevent slippage of the paper laterally, longitudinally, and angularly. Therefore, the narrow rigid sections formed by the teeth and the narrow resilient sections formed by the urethane material combine to accurately move any type of paper or other strip material without cutting, creasing or smudging of the strip material.

In a typical strip feed situation two or more strip feed rollers of this invention are in juxtaposed parallel relationship and engage paper which is positioned between the rollers.

BRIEF DESCRIPTION OF THE VIEWS OF THE DRAWINGS

FIG. 1 is a perspective view illustrating a plurality of strip feed rollers of this invention in engagement with a strip of paper in a folding operation.

FIG. 2 is a perspective view with parts broken away and shown in section, showing a strip feed roller of this invention. This view is drawn on a much larger scale than FIG. 1.

FIG. 3 is an enlarged fragmentary sectional view taken substantially on line 3—3 of FIG. 2. This view shows the surface of the roller prior to completion of processing the surface of the roller.

FIG. 4 is an enlarged fragmentary sectional view, drawn on the same scale as FIG. 3, and showing the surface of the strip feed roller following processing thereof.

FIG. 5 is an enlarged fragmentary sectional view, drawn on a larger scale than FIG. 4, showing a portion of the strip feed roller illustrated in FIG. 4.

FIG. 6 is a diagrammatic sectional view, drawn on a smaller scale than FIG. 4, showing two strip feed rollers of this invention and illustrating a portion of a strip of material as the strip is moved by rotation of the rollers.

DETAILED DESCRIPTION OF THE PREFERRED EMBODIMENT

FIG. 1 shows a plurality of strip feed rollers or cylinders 10 of this invention. In FIG. 1 the rollers 10 are shown as being arranged for feeding a strip 14 of paper in a folding operation.

FIG. 2 shows, in greater detail, one of the strip feed cylinders 10.

FIGS. 3, 4, and 5 show, in still greater detail, portions of a strip feed cylinder or roller 10 of this invention.

A basic strip feed roller 10 is preferably composed of relatively hard material, such as metallic material or the like. In production, the roller 10 is knurled, or otherwise formed, to produce a multiplicity of axially extending teeth 20 and valleys 22, in alternate positions, as shown in FIG. 3. Then the surface of the roller 10 is covered with a rubber or rubber-like material, such as urethane 30 or the like, as the valleys 22 are filled with the urethane material. Preferably, the urethane material has a durometer value in the range of about 65 to 75.

Then the surface of the roller 10 is cut to form a cylindrical surface of constant diameter along the length of the cylinder. The surface is cut to reduce the diameter of the roller and to expose only the upper portion of the teeth 20. In the cutting of the surface of the roller, the peaks of the teeth 20 are removed. Thus, as shown in FIGS. 4 and 5, each tooth 20 presents a narrow exposed surface which forms an axially extending narrow rigid section at the surface of the cylinder 10. Between adjacent teeth 20 is an axially extending narrow section of urethane material 30. The teeth 20 and the urethane material 30 form a smooth cylindrical surface upon the roller 10. Thus, there are alternate narrow rigid sections and alternate narrow resilient sections at the surface of the roller 10, as illustrated in FIGS. 4, 5, and 6. Due to the fact that each rigid section and each resilient section is a part of the cylindrical surface, each narrow rigid section and each narrow resilient section is slightly arcuate across the width thereof.

Therefore, as each cylinder or roller 10 rotates and engages a strip 14, in a manner such as illustrated in FIGS. 1 and 6, the strip 14 is accurately and precisely moved. The rigid metallic surface of the teeth 20 provide firm gripping of the strip 14. The narrow sections of urethane material 30 provide a cushioned surface for movement of the strip 14, and prevent creasing and wrinkling and/or cutting of the strip 14. The cylinders 10, which include the combined alternate narrow rigid surfaces and narrow resilient surfaces, accurately move the strip 14, or any strip, without lateral, or angular, or longitudinal slippage. When the strip 14, shown in FIGS. 1 and 6, comprises pressure sensitive carbonless copy paper, the paper does not smudge as it is moved by the cylinders 10.

Although the preferred embodiment of a strip feed roller of this invention has been described, it will be understood that within the purview of this invention various changes may be made in the form, details, proportion and arrangement of parts, the combination thereof, and the mode of operation, which generally stated consist in a structure within the scope of the appended claims.

What is claimed is:

1. A strip feed roller for movement of paperlike material which comprises an elongate cylindrical member provided with a peripheral surface region, the peripheral surface region including sections of rigid material and alternately positioned sections of resilient material, the diameter of the peripheral surface region in which the sections of rigid material are located being the same diameter as the diameter of the peripheral surface region in which the sections of resilient material are located, the sections of rigid material and the sections of resilient material thus providing a smooth cylindrical surface by which the elongate cylindrical member has a constant diameter, whereby the strip feed roller is capable of extreme accuracy in feeding strips of material of various compositions, without cutting the strip and without fracturing capsules which may be present as a part of the strip.

2. The strip feed roller of claim 1 in which the sections of rigid material are sections of metallic material.

3. The strip feed roller of claim 1 in which the sections of resilient material are sections of urethane material.

4. The strip feed roller of claim 1 in which the sections of resilient material are sections of urethane material, and in which the sections of rigid material are sections of metallic material.

5. The strip feed roller of claim 1 in which the sections of resilient material are sections of urethane material in which the urethane material has a durometer value in the range of about 65 to 75.

6. A roller for movement of strips of paperlike material comprising an elongate body provided with a cylindrical surface in which the surface includes a plurality of linear regions of rigid material and a plurality of linear regions of a resilient material, the diameter of the cylindrical surface in the regions of rigid material being the same diameter as the diameter of the cylindrical surface in the regions of resilient material, the linear regions thus providing a smooth cylindrical surface of constant diameter throughout the length of the elongate body, whereby the roller is capable of extreme accuracy in the feeding of strips of paperlike material of various compositions, without cutting the strip of paper-like material and without rupturing capsules which may be present as a part of the strips of paper-like material.

7. The roller of claim 6 in which the linear regions of rigid material are of metallic material.

8. The roller of claim 6 in which the linear regions of resilient material are regions of urethane material.

9. The roller of claim 6 in which the linear regions of resilient material are regions of rubberlike material.

10. The roller of claim 6 in which the linear regions of resilient material are regions or urethane material having a durometer value in the range of about 65 to 75.

11. The roller of claim 6 in which the linear regions of rigid material are axially extending regions.

12. The roller of claim 6 in which the linear regions of resilient material are axially extending regions.

13. The roller of claim 6 in which the linear regions of resilient material and the linear regions of rigid material are axially extending regions.

14. A strip feed roller for paper-like material which includes means forming a smooth cylindrical surface of constant diameter and which comprises alternating elongate substantially straight axially extending sections of a rigid material and alternating elongate substantially straight axially extending sections of resilient material, the diameter of the cylindrical surface in which the sections of rigid material is located being the same diameter as the diameter of the cylindrical surface in which the sections of resilient material is located to provide a cylindrical surface of constant diameter, whereby the paper feeding of strips of paper-like material of various compositions, without cutting the strips and without rupturing capsules which may be present as a part of the strips.

15. The paper feed roller of claim 14 in which the rigid material is a metallic material.

16. The paper feed roller of claim 14 in which the resilient material is urethane material.

17. The paper feed roller of claim 14 in which the resilient material is urethane material and in which the rigid material is a metallic material.

18. The strip feed roller of claim 1 in which the peripheral surface region includes sections of rigid metallic material and alternately positioned sections of urethane material.

19. The strip feed roller of claim 1 in which the peripheral surface region includes axially extending strips of rigid material and alternately positioned axially extending strips of resilient material.

20. The strip feed roller of claim 1 in which the sections of rigid material and the sections of resilient material are axially extending sections.

* * * * *

UNITED STATES PATENT AND TRADEMARK OFFICE

CERTIFICATE OF CORRECTION

PATENT NO. : 4,917,283

DATED : April 17, 1990

INVENTOR(S) : Franklin L. Weatherhead and Harold E. Boyer

It is certified that error appears in the above-identified patent and that said Letters Patent is hereby corrected as shown below:

Column 4, line 47, after "paper" insert ---feed roller is capable of extreme accuracy in the---.

Signed and Sealed this

Thirtieth Day of July, 1991

*Attest:*

HARRY F. MANBECK, JR.

*Attesting Officer*

*Commissioner of Patents and Trademarks*